US007090011B2

(12) United States Patent
Khomynets et al.

(10) Patent No.: US 7,090,011 B2
(45) Date of Patent: Aug. 15, 2006

(54) METHOD FOR OPERATING A WELL JET DEVICE DURING REPAIR AND INSULATING OPERATIONS AND DEVICE FOR CARRYING OUT SAID METHOD

(76) Inventors: Zinoviy Dmitrievich Khomynets, d.33,ul.Vilshanetskaya, Tismenitsa, obl.Ivano-Frankovskaya 77400 (UA); Vladimir Petrovich Stenin, ul.Kulakova, 10-88, Moscow 123592 (RU); Aleksandr Aleksandrovich Vaygel, ul.Dmitriya Ulyanova, 28-1-44, Moscow 117036 (RU)

( * ) Notice: Subject to any disclaimer, the term of this patent is extended or adjusted under 35 U.S.C. 154(b) by 128 days.

(21) Appl. No.: 10/485,437

(22) PCT Filed: May 30, 2002

(86) PCT No.: PCT/RU02/00263
§ 371 (c)(1),
(2), (4) Date: Aug. 2, 2004

(87) PCT Pub. No.: WO03/012300
PCT Pub. Date: Feb. 13, 2003

(65) Prior Publication Data

US 2004/0238164 A1 Dec. 2, 2004

(30) Foreign Application Priority Data

Jul. 31, 2001 (RU) ..... 2001121297
Sep. 11, 2001 (RU) ..... 2001124749

(51) Int. Cl.
*E21B 47/12* (2006.01)

(52) U.S. Cl. ..... 166/254.2; 166/68; 166/106

(58) Field of Classification Search ..... None
See application file for complete search history.

(56) References Cited

U.S. PATENT DOCUMENTS 4,293,283 A * 10/1981 Roeder ..... 417/172
4,744,730 A * 5/1988 Roeder ..... 417/172

FOREIGN PATENT DOCUMENTS

RU 2059891 C1 * 5/1996
RU 2129671 C1 * 4/1999
SU 1146416 A * 3/1985

* cited by examiner

*Primary Examiner*—Zakiya W. Bates
(74) *Attorney, Agent, or Firm*—Dellett & Walters

(57) ABSTRACT

The inventive method consists in the following: a drillable packer provided with a channel closed by a back valve is arranged in a well; afterwards a tubing string carrying a jet pump and a stinger is run into said well, the stringer being connected to the packer; the back valve is open; a logging instrument and a sealing unit are introduced into the tubing string with the aid of a cable; a depression is produced on the formation by means of the pump, a bottomhole pressure and the parameters of the formation are measured with the aid of said instrument, the parameters of physical fields being recorded. The results of said investigations being interpreted, the technical state of the well is defined. The instrument and the sealing unit being extracted from the tube string, a blocking insert is dropped therein. The tubing string is uplifted, the stringer is disconnected from the packer and the back valve is closed. A cement slurry being pumped into the tubing string, said tubing string is put down, the stringer is connected to the packer and the back valve is open. The cement slurry is pumped into the tail space, squeezed into the productive formation and the tubing string together with the pump and the stringer is extracted. The cement slurry being hardened, the packer is drilled out, the formation is perforated and the tubing string provided with a guiding cone, the packer and the pump is brought in the well. Said invention increases the reliability of the repair and insulating operations.

2 Claims, 5 Drawing Sheets

METHOD FOR OPERATING A WELL JET DEVICE DURING REPAIR AND INSULATING OPERATIONS AND DEVICE FOR CARRYING OUT SAID METHOD

FIELD OF THE INVENTION

This invention relates to the field of jet equipment, mainly to well jet units used while carrying out restoration and repair and insulating works in wells.

PRIOR ART

Known in the art is a method of operating a well jet unit, which includes lowering the piping string with a jet pump, a packer and a puncher into the well, arranging the puncher against the producing formation and blasting the puncher with subsequently pumping the liquid working medium through the jet pump (SU 1146416 A).

Known from the same source is a well jet unit comprising a piping string with a jet pump, a packer and a puncher, the latter being arranged below the jet pump and against the producing formation.

The known method and unit enable to perforate boreholes at a set depression value and pump out of the well different extracted media, e.g., oil, while simultaneously intensifying the medium production out of the formation.

But the said method and unit do not enable to install the production equipment in the well below the jet pump as well as to replace the latter in the process of operation without packer releasing in the piping string, which lowers the efficiency of the well development operations.

The closest, as to its technical essence and the achievable result, to this invention in the part of the method is a method of operating a well jet unit, which comprises lowering a jet pump and a packer on the piping string and installing them above the producing formation, lowering a transmitter and receiver-transducer of physical fields on a cable, the said cable being passed through a sealing assembly arranged thereon, and creating depression on the formation with the use of the jet pump (RU 2129671 C1).

The known method of operating a well jet unit enables to carry out various production operations in the well below the level at which the jet pump is arranged, including those carried out by creating pressure differential above and below the sealing assembly.

But the said method of operating the unit does not enable to carry out the complete complex of works on exploring and restoring wells, which narrows its field of application.

The closest, as to its technical essence and the achievable result, to this invention in the part of the device is a well jet unit comprising installed on the piping string a packer a jet pump with the active nozzle, the mixing chamber and a through passage having the mounting seat for installing a sealing assembly, the said unit being provided with a transmitter and receiver-transducer of physical fields, which is arranged in the area below the packer on the side of entry of the pumped-out medium into the jet pump and installed on the well-logging cable passed through the axial passage of the sealing assembly, the output side of the jet pump being connected to the area around the piping string, the input side of the passage for supplying the pumped-out medium to the jet pump being connected to the inner cavity of the piping string below the sealing assembly, and the input side of the passage for supplying the liquid working medium to the active nozzle being connected to the inner cavity of the piping string above the sealing assembly (RU 2059891 C1).

The known well jet unit enables to carry out various production operations in wells below the level at which the jet pump is arranged, including those carried out by creating pressure differential above and below the sealing assembly.

But the said unit does not enable to carry out the complete complex of works on exploring and restoring wells, which narrows its field of application.

DESCRIPTION OF THE INVENTION

The objective of this invention is to raise the reliability of repair and insulating works carried out with the use of a well jet unit on account of expanding the capabilities of the unit and optimizing the operations carried out in wells.

The stated objective in the part of the method is achieved owing to the fact that the method of operating a well jet unit while carrying out repair and insulating works comprises prior arranging in the well, above the producing formation roof, a drillable packer having a through passage, the throat of the latter being closed by a check valve, lowering in the well the piping string with a jet pump and a stinger shank, which are successively arranged thereon, the said jet pump being arranged in the housing in which a through passage with the mounting seat is made, and the said stinger shank being arranged below the said housing and being intended for slip connection with and disconnection from the said drillable packer; then the stinger shank is connected with the drillable packer, the check valve opens thus connecting the under-packer area with the inner cavity of the piping string; then a well logging device on the logging cable is lowered into the well through the inner cavity of the piping string, a sealing assembly being movably arranged on the logging cable above the said well logging device and being installed at the mounting seat in the through passage made in the housing of the jet pump; in doing this the reciprocal motion of the logging cable is ensured both at the operating and non-operating jet pump; after the well logging device has reached the interval of the producing formation, it is installed in a fixed position, and by supplying the working fluid to the nozzle of the jet pump several values of depression on the formation are created with the duration sufficient for stabilizing the bottom-hole pressure and enabling the inflow of fluids from the formation; the bottom-hole pressure and the parameters of the formation fluid are registered in this operation mode with the use of the well logging device, after which the parameters of the physical fields are recorded at several fixed values of the depression on the formation while moving the well logging device along the well in the under-packer area; and after the study program is completed the obtained results are interpreted, the results of such interpretation are used for the identification of the watering sources and the technical condition of the well; then, the well logging device with the sealing assembly are removed out of the well, and, if necessary, geo-technical measures, such as acid treatments, formation impacting with momentary cyclic depressions - repressions, formation re-shots, acoustic impact on the formation bottom-hole area in the depression mode, all of which are aimed at the creation of the necessary hydrodynamic connection between the formation and the well and are carried out with the use of the jet pump; then the study cycle is repeated with the use of the well logging devices in the mode of depression on the formation; then the well logging device together with the sealing assembly is removed out of the well, and a blocking insert having a through passage is dropped into the inner cavity of the piping string and arranged in the through passage of the jet pump housing, the said blocking insert being used for closing the passages for supplying the active medium and the medium pumped out by the jet pump and, thus, for separating the hole clearance and the cavity inside the piping string; after this the piping string is slightly raised, thus disconnecting the whole arrangement from the packer, closing the check valve and dividing, due to this, the well space into the above-packer area and the under-packer area; then a grouting mortar is pumped into the piping string and, after it reaches the lower portion of the stinger shank, the piping string is lowered again, the stinger shank is connected to the drillable packer and the check valve opens; then the grouting mortar is pumped into the under-packer area for peening into the producing formation; then the piping string together with the jet pump and the stinger shank are removed out of the well, and after expiration of the calculated time for grouting mortar hardening the packer and the cement bridge formed in the result of the grouting mortar hardening are drilled, the formation is perforated in the calculated range of depths, and the piping string is lowered into the well with a shank having the guiding cone, the packer and the jet pump having the through passage with the mounting seat in its housing, all of them being arranged down-top on the piping string; after this the packer is released, and the whole cycle of logging and hydrodynamic studies is carried out proceeding from the results of which a decision is taken whether to put the well into operation or to conduct additional studies or works for intensifying the well production; and after this the measures for putting the well into operation may be performed.

The stated objective in the part of the device is achieved owing to that the well jet unit comprises, on the piping string, the packer and the jet pump with the active nozzle, the mixing chamber and the through passage with the mounting seat for arranging the sealing assembly, the unit being provided with the transmitter and receiver-transducer of physical fields, which is arranged in the under-packer area on the side where the medium pumped out of the well enters the jet pump and which is installed on the logging cable passed through the axial passage of the sealing assembly, the output side of the jet pump is connected to the area around the piping string, the input side of the passage for supplying the pumped out medium to the jet pump is connected to the inner cavity of the piping string below the sealing assembly, and the input side of the passage for supplying the liquid working medium to the active nozzle is connected to the inner cavity of the piping string above the sealing assembly; the unit being provided with the stinger shank intended for slip connection with and disconnection from the drillable packer preliminary arranged in the well and made with the through passage and the check valve closing the throat of that passage and having the possibility of opening to the side of the producing formation; the packer is made with a central passage and a shank with the guiding cone, being arranged lower than the packer, and is arranged with the possibility of being replaced by the stinger shank, the inner diameters of the stinger shank and the shank with the guiding cone are at least 1 mm greater that the diameter of the transmitter and the receiver-transducer of physical fields; the sealing assembly is arranged with the possibility of being replaced by other functional inserts, such as, a blocking insert, a pressurizing insert, a depression insert or an insert for recording formation pressure restoration curves with the use of autonomous well instruments; and the transmitter and receiver-transducer of physical fields is made with the possibility of being replaced by other well instruments, e.g., a puncher or a device for acoustically impacting the producing formation.

In the course of the studies conducted it has been established that the carrying out of the production operations in wells with the use of the well jet unit in the defined succession and with auxiliary equipment enables to raise the reliability of repair works in the well to a great extent. The arrangement in the well of a drillable packer having a through passage and a check valve in combination with the arrangement the well jet unit above the said packer has enabled to expand the possibilities of dividing the well space. The possibility is provided of separating not only the above-packer area from the under-packer area, but also the space around the piping string from the inner cavity of the piping string, the said separation being possible in various combinations, which enables to expand the possibilities of both studying and repairing the well. The inventive proposal enables to combine in the single production cycle seemingly not interconnected works, such as creation of different depressions and repressions on the formation, supply of a grouting mortar into the well, acid treatment of the well and perforation of the well. In the result the optimal technological chain of operations has been selected in order to study the well after arranging a drillable packer therein, which includes the registration of bottom-hole pressure and the formation fluid parameters at several values of depression on the formation, such studies being conducted both at the operating and non-operating jet pump while moving the well logging instrument—transmitter and receiver-transducer of physical fields—along the well. Further, on the basis of the data thus obtained the possibility has been provided to conduct strictly defined works on improving the hydrodynamic connection between the producing formation and the well, where such works may include acid treatment of the well, acoustic impact on the formation and re-shots of the formation (carrying out the works on perforating the formation by blasting pyrotechnic devices). Moreover, the possibility has been provided to carry out the works on putting wells into the operation mode, which include supply of a grouting mortar (preferably a cement slurry) into the well, drilling of the hardened grouting mortar and the drillable packer and perforation of the formation. After this is possible to arrange in the well a well jet unit having a packer and a shank with the guiding cone to be used in the future both for conducting further studies of the well and carrying out works on raising the well production and for operating it with a pump for forced production of, e.g., oil, which is installed above the packer. The making of the inner diameter of the stinger shank and that of the shank with the guiding cone at least 1 mm greater than the diameter of the transmitter and receiver-transducer of physical fields enables to reduce the probability that logging and other instruments lowered to the area of the producing formation may get stuck in the above mentioned shanks, which raises the reliability of operating the well jet unit.

Thus, the unit, as described above, enables to perform a certain succession of actions and create a reliable method of operating the well jet unit when carrying repair and insulating works in wells.

DESCRIPTION OF THE PREFERRED EMBODIMENT

Figure 1:
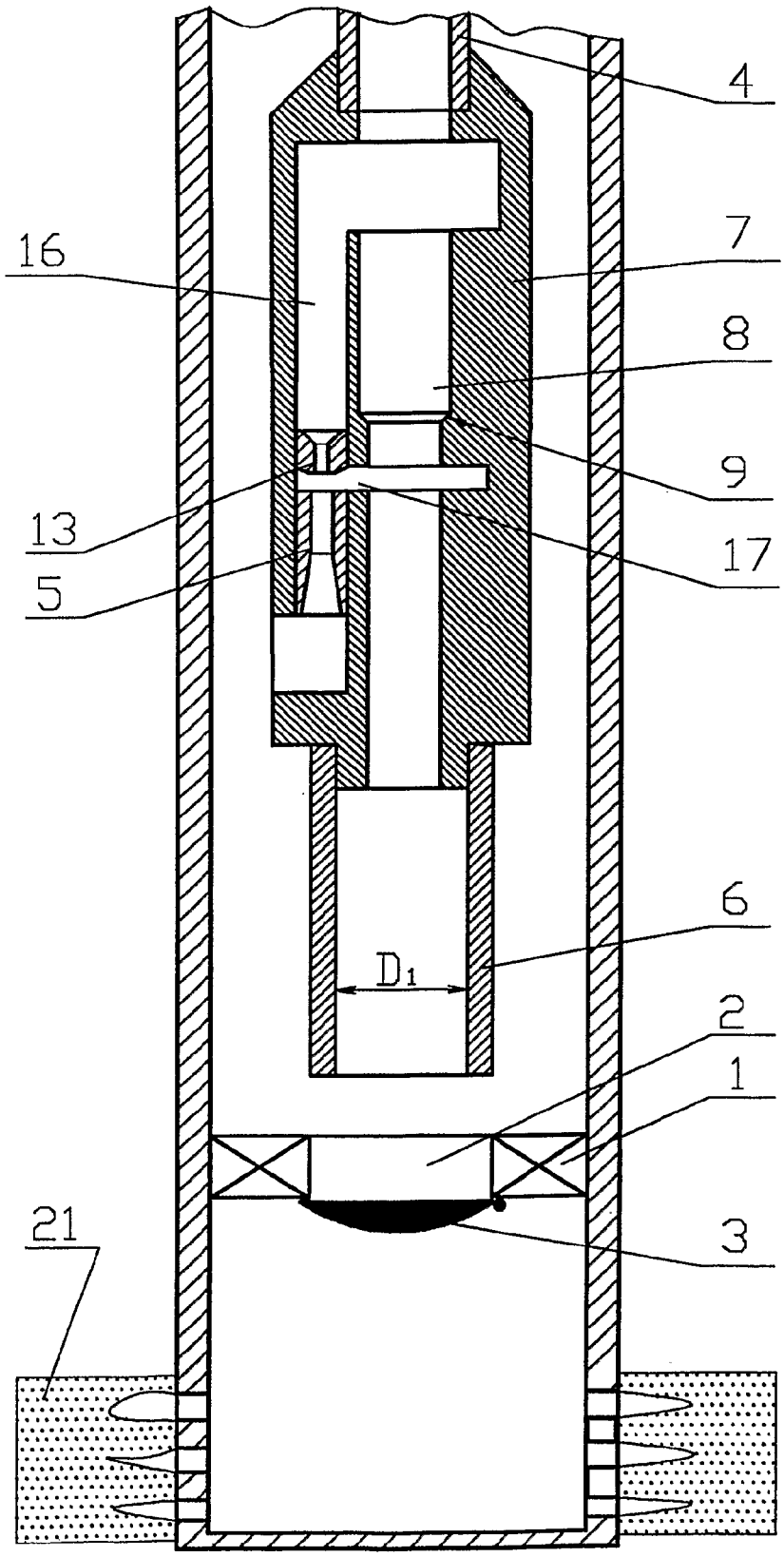
FIG. 1 is a schematic representation of the well jet unit at the time of lowering the piping string with the jet pump and the stinger shank.
Figure 2:
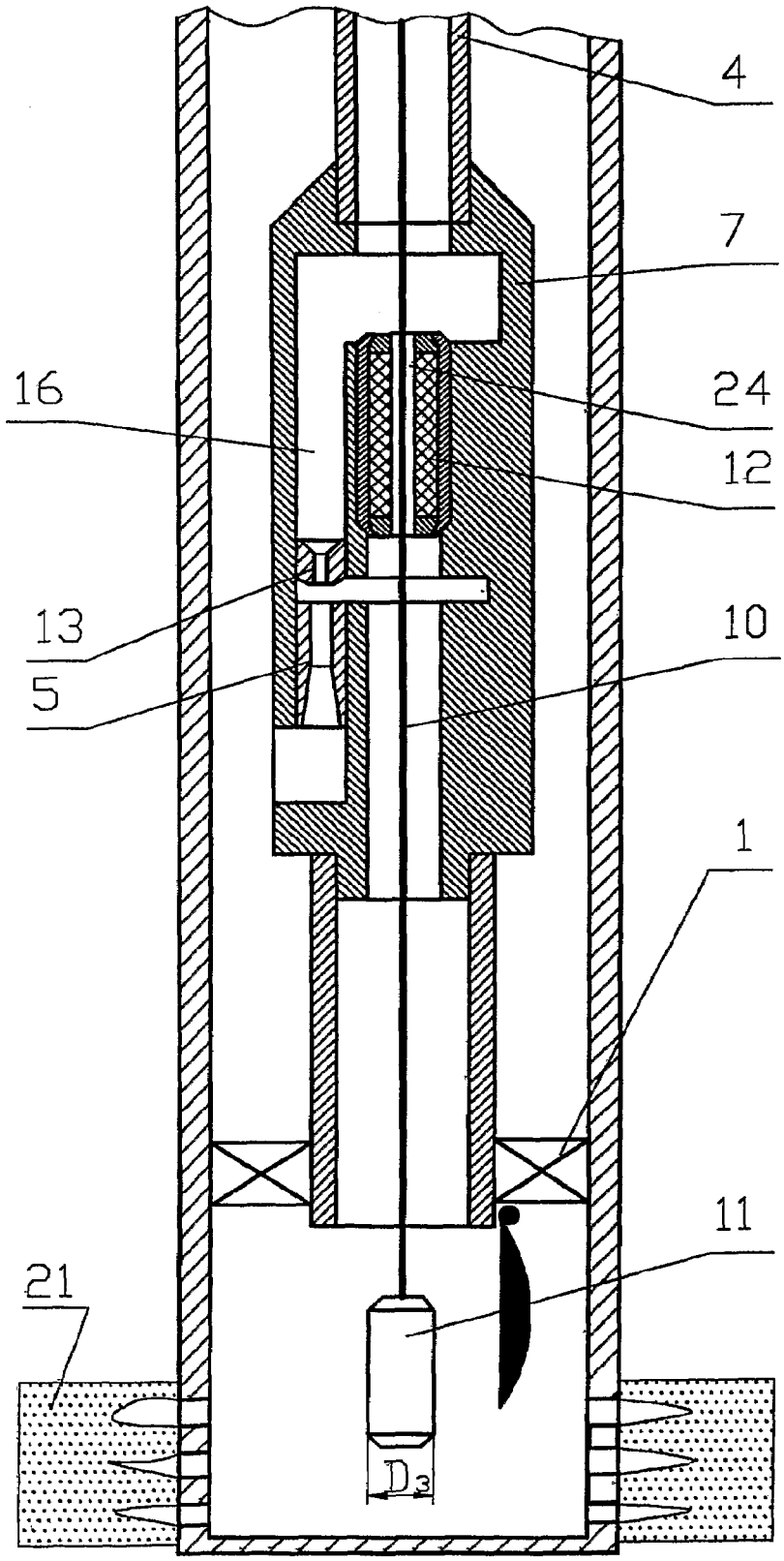
FIG. 2 is a schematic representation of the well jet unit at the time of lowering the well logging device after the stinger shank has been arranged in the drillable packer.
Figure 3:
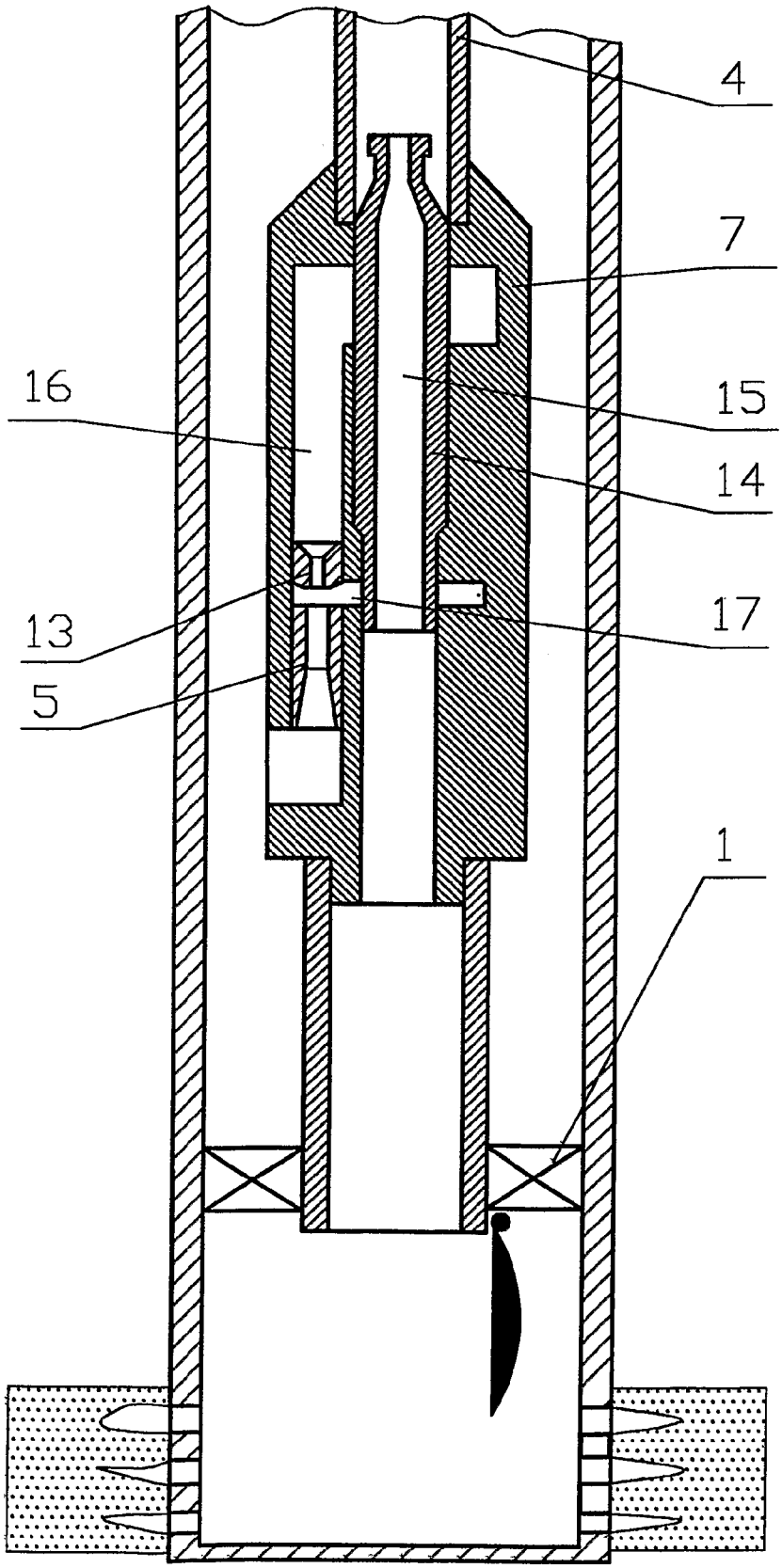
FIG. 3 is a schematic representation of the well jet unit with the jet pump and a blocking insert arranged in the said pump.
Figure 4:
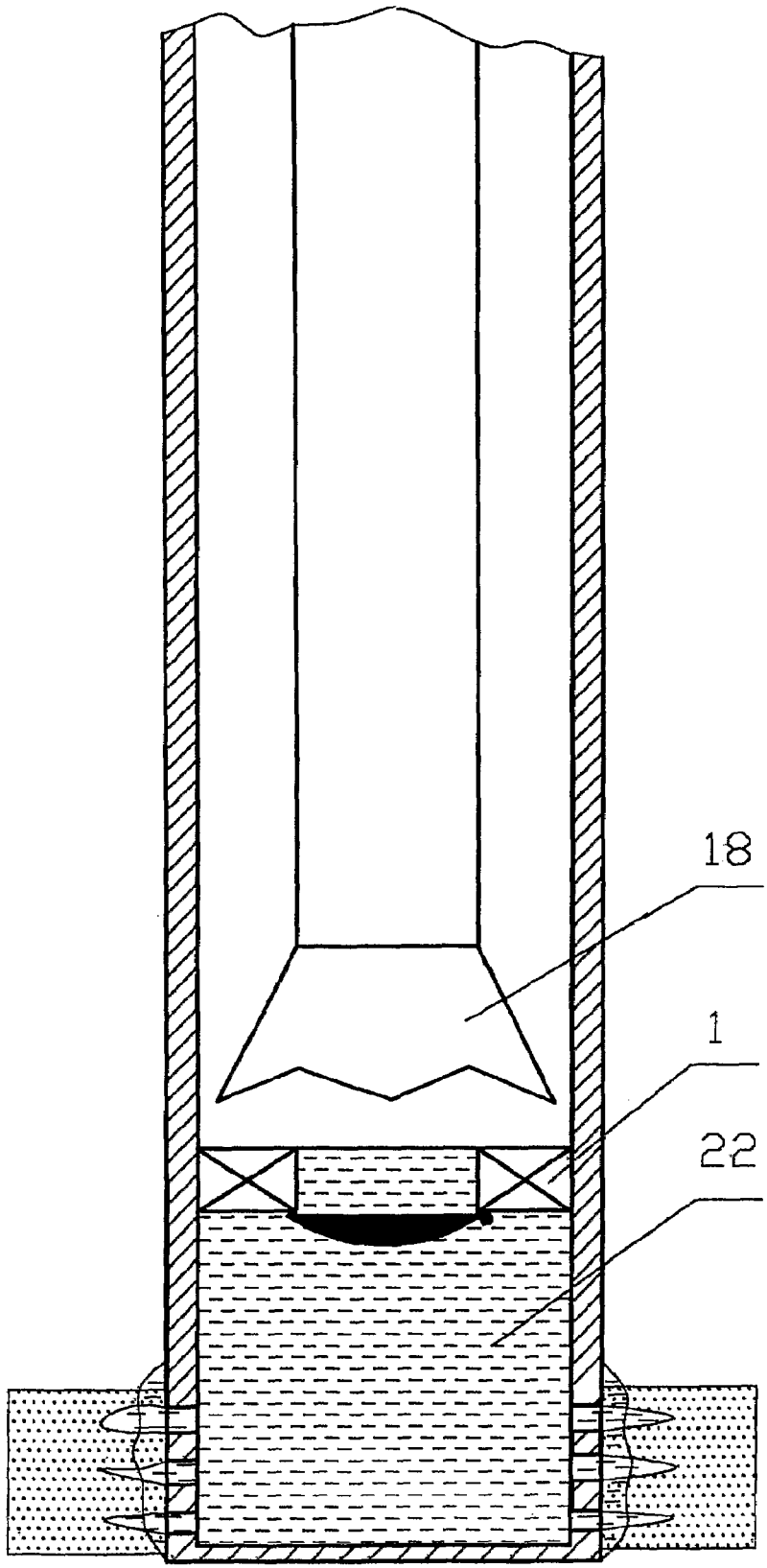
FIG. 4 is a schematic representation of the well jet unit at the time of drilling the cement bridge and the drillable packer.
Figure 5:
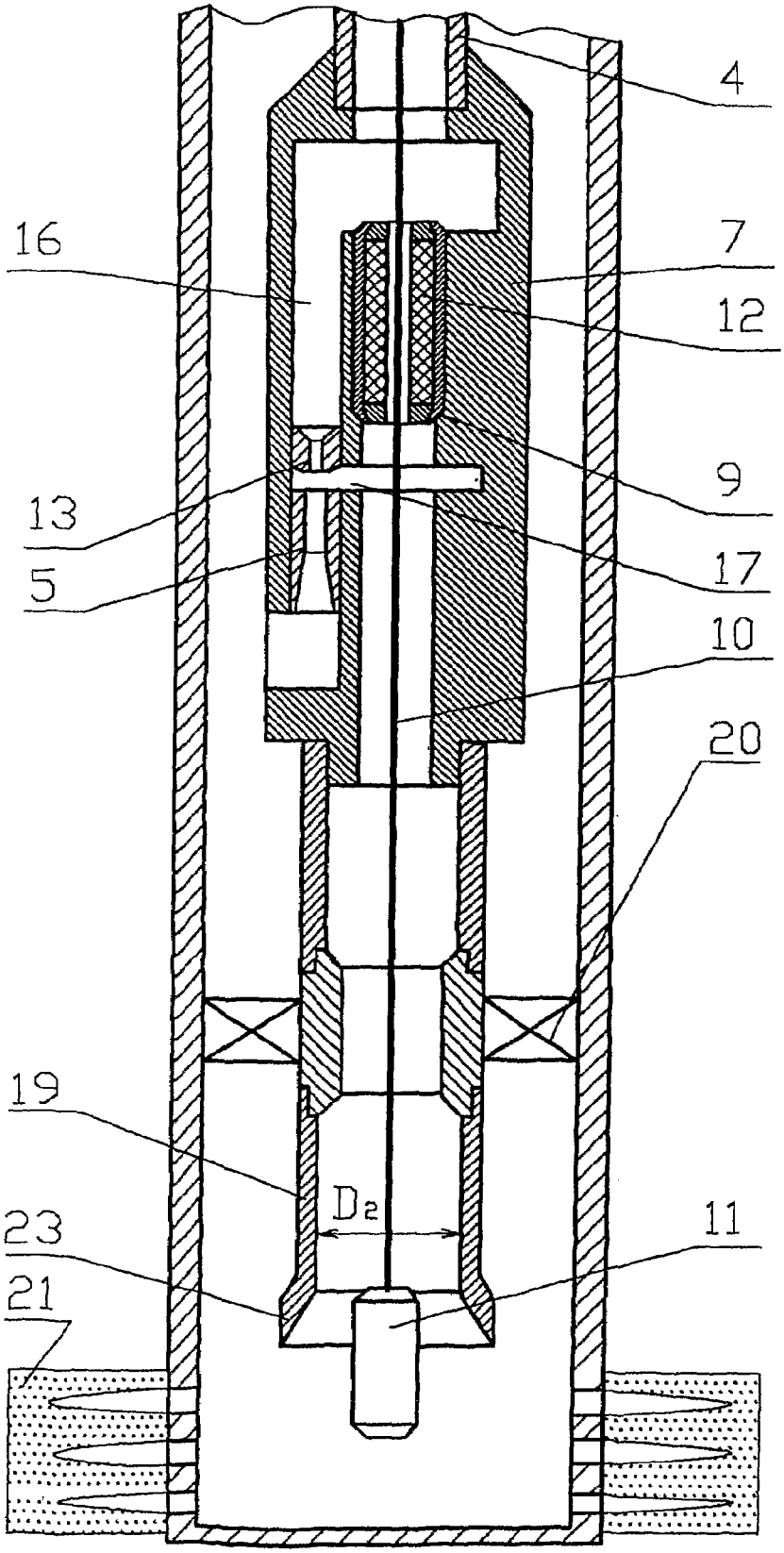
FIG. 5 is a schematic representation of the well jet unit after the arrangement of the piping string together with the jet pump, the packer and the shank having the guiding cone.

The inventive well jet unit for implementing the described method comprises a drillable packer 1, which has been arranged in advance in the well above the producing formation 21, with the through passage 2, which throat is closed by a check valve 3 being capable of opening to the side of the producing formation, and the piping string 4, on which the jet pump 5 and the stinger shank 6 are arranged successively. The jet pump 5 with the active nozzle 13 is provided with the housing 7, in which the through passage 8 with the mounting seat 9 is made, the output side of the jet pump 5 is connected to the area around the piping string 4, the input side of the passage for supplying the pumped out medium 17 to the jet pump 5 is connected to the inner cavity of the piping string 4 below the sealing assembly 12, and the input side of the passage for supplying the liquid working medium 16 to the active nozzle 13 is connected to the inner cavity of the piping string 4 above the sealing assembly 12. The stinger shank 6 is arranged below the housing 7 of the jet pump 5 and is intended for slip connection with and disconnection from the drillable packer 1. The well logging device 11—a transmitter and receiver-transducer of physical fields—may be lowered into the well on the logging cable 10 (a wire may be used instead of the logging cable) passed through the axial passage 24 in the sealing assembly 12. The sealing assembly 12 is arranged at the mounting seat 9 in the through passage 8 made in the housing 7 of the jet pump 5 with ensuring the reciprocal movements of the logging cable 10 both at the operating and non-operating jet pump 5. Instead of the sealing assembly 12 in the through passage 8, at the mounting seat 9 the blocking insert 14 may be arranged, which has the through passage 15 and closes the passages for supplying the liquid working (active) medium 16 and the pumped out medium 17 to the jet pump 5, thus separating the space around the piping string 4 from the inner cavity of the piping string 4. The packer 1 and the cement bridge 22 may be drilled with the use of the drill bit 18. After drilling, the shank 19 with the guiding cone 23, the packer 20 with the central passage and the jet pump 5 having the through passage 8 with the mounting seat 9 in its housing 7 may be arranged down-top on the piping string 4. The inner diameter $D_1$ of the stinger shank 6 and the inner diameter $D_2$ of the shank 19 with the guiding cone 23 are at least 1 mm greater that the diameter $D_3$ of the transmitter and the receiver-transducer of physical fields 11.

The described method of operating the well jet unit while carrying out repair and insulating works is implemented as follows.

First, in the well, above the roof of the producing formation 21, a drillable packer 1 is arranged, which has the through passage 2 and the check valve 3 closing the throat of the said through passage. Then the piping string 4 is lowered into the well with the jet pump 5 and the stinger shank 6, which are successively arranged on the piping string 4. After this the stinger shank 6 is connected with the drillable packer 1, and the check valve 3 opens thus connecting the under-packer area with the inner cavity of the piping string 4. Then the well logging device 11 is lowered on the logging cable 10 into the well through the inner cavity of the piping string 4 with the sealing assembly 12 movably arranged on the logging cable 10 and installed at the mounting seat 9 in the through passage 8 made in the housing 7 of the jet pump 5 while ensuring the reciprocal motion of the logging cable 10 both at the operating and non-operating jet pump 5. After the well logging device 11 has reached the interval of the producing formation 21 it is installed in a fixed position, and by supplying the working fluid to the nozzle 13 of the jet pump 5 several values of depression on the formation 21 are created with the duration sufficient for stabilizing the bottom-hole pressure and enabling the inflow of fluids from the formation 21, the bottom-hole pressure and the parameters of the formation fluid are registered in this operation mode with the use of the well logging device 11. Then the parameters of the physical fields are recorded at several fixed values of the depression on the formation 21 while moving the well logging device 11 along the well in the under-packer area. After the study program is completed the obtained results are interpreted, the results of such interpretation are used for the identification of the watering sources and the technical condition of the well; then, the well logging device 11 with the sealing assembly 12 are removed out of the well. Then, if necessary, geo-technical measures are carried out through the jet pump 5 for the purpose of creating the necessary hydrodynamic connection between the formation and the well, such as acid treatments, impact with momentary cyclic depressions—repressions on the formation 21, re-shots of the formation 21, acoustic impact on the bottom-hole area of the formation 21 in the depression mode, etc., and the study cycle is repeated with the use of the well logging devices 11 in the mode of depression on the formation 21. Then the well logging device 11 together with the sealing assembly 12 is removed out of the well, and the blocking insert 14 having the through passage 15 is dropped into the inner cavity of the piping string 4 and arranged in the through passage 8 in the housing 7 of the jet pump 5, the said blocking insert 14 being used for closing the passages 16, 17 for supplying the liquid working (active) medium and the medium pumped out by the jet pump 5 and, thus, for separating the clearance around the piping string 4 and the cavity inside the piping string 4. After this the piping string 4 is slightly raised, thus disconnecting the stinger shank 6 from the packer 1, closing the check valve 3 and dividing, due to this, the well space into the above-packer area and the under-packer area. Then a grouting mortar (e.g., a cement slurry) is pumped into the piping string 4 and, after it reaches the lower portion of the stinger shank 6, the piping string 4 is lowered again, the stinger shank 6 is connected to the packer 1 and the check valve 3 opens. Then the piping string 4 together with the jet pump 5 and the stinger shank 6 are removed out of the well, and after expiration of the calculated time for grouting mortar hardening the packer 1 and the cement bridge 22, which have been formed in the result of the grouting mortar hardening, are drilled with the use of the drill bit 18. After this the formation 21 is perforated in the calculated range of depths, and the piping string 4 is lowered into the well with the shank 19 having the guiding cone 23, the packer 20 and the jet pump 5 having the through passage 8 with the mounting seat 9 in its housing 7, all of them being arranged down-top on the piping string 4. Then the packer 20 is released, and the whole cycle of logging and hydrodynamic studies is carried out proceeding from the results of which a decision is taken whether to put the well into operation or to conduct additional works for intensifying the well production; and after this the measures for putting the well into operation may be performed.

INDUSTRIAL APPLICABILITY

This invention may be applied in the oil industry in repair and insulating works, repair and restoration works, as well as when testing and developing wells in other industries where various media are extracted from wells.

What is claimed is:

1. The method of operating the well jet unit while carrying out repair and insulating works, which consists in that in the well, above the producing formation roof, a drillable packer is arranged having a through passage, the throat of the latter being closed by a check valve, the piping string is lowered in the well with a jet pump and a stinger shank, which are successively arranged thereon, the said jet pump being arranged in the housing in which a through passage with the mounting seat is made, and the said stinger shank being arranged below the said housing and being intended for slip connection with and disconnection from the said drillable packer; then the stinger shank is connected with the drillable packer, the check valve opens thus connecting the under-packer area with the inner cavity of the piping string, then a well logging device on the logging cable is lowered into the well through the inner cavity of the piping string, a sealing assembly being movably arranged on the logging cable above the said well logging device and being installed at the mounting seat in the through passage made in the housing of the jet pump, in doing this the reciprocal motion of the logging cable is ensured both at the operating and non-operating jet pump, after the well logging device has reached the interval of the producing formation, it is installed in a fixed position, and by supplying the working fluid to a nozzle of the jet pump several values of depression on the formation are created with the duration sufficient for stabilizing the bottom-hole pressure and enabling the inflow of fluids from the formation, the bottom-hole pressure and the parameters of the formation fluid are registered in this operation mode with the use of the well logging device, after which the parameters of the physical fields are recorded at several fixed values of the depression on the formation while moving the well logging device along the well in the under-packer area, and after a study program is completed, the obtained results are interpreted, and the results of such interpretation are used for the identification of the watering sources and the technical condition of the well, then, the well logging device with the sealing assembly are removed out of the well, and, if necessary, geo-technical measures, such as acid treatments, formation impacting with momentary cyclic depressions—repressions, formation re-shots, acoustic impact on the formation bottom-hole area in the depression mode, all of which are aimed at the creation of the necessary hydrodynamic connection between the formation and the well and are carried out with the use of the jet pump, then the study cycle is repeated with the use of the well logging devices in the mode of depression on the formation, then the well logging device together with the sealing assembly is removed out of the well, and a blocking insert having a through passage is dropped into the inner cavity of the piping string and arranged in the through passage of the jet pump housing, the said blocking insert being used for closing the passages for supplying the active medium and the medium pumped out by the jet pump and, thus, for separating the hole clearance around the piping string and the cavity inside the piping string, after this the piping string is slightly raised, thus disconnecting the whole arrangement from the packer, closing the check valve and dividing, due to this, the well space into the above-packer area and the under-packer area; then a grouting mortar is pumped into the piping string and, after it reaches the lower portion of the stinger shank, the piping string is lowered again, the stinger shank is connected to the drillable packer and the check valve opens, then the grouting mortar is pumped into the under-packer area for peening into the producing formation, then the piping string together with the jet pump and the stinger shank are removed out of the well, and after expiration of the calculated time for grouting mortar hardening the packer and the cement bridge formed in the result of the grouting mortar hardening are drilled, the formation is perforated in the calculated range of depths, and the piping string is lowered into the well with a shank having the guiding cone, the packer and the jet pump having the through passage with the mounting seat in its housing, all of them being arranged down-top on the piping string; after this the packer is released, and the whole cycle of logging and hydrodynamic studies is carried out proceeding from the results of which a decision is taken whether to put the well into operation or to conduct additional works for intensifying the well production; and after this the measures for putting the well into operation may be performed.

2. The well jet unit of claim 1 comprising, on the piping string, the packer and the jet pump with the active nozzle, the mixing chamber and the through passage with the mounting seat for arranging the sealing assembly, the said unit being provided with the transmitter and receiver-transducer of physical fields, which is arranged in the under-packer area on the side where the medium pumped out of the well enters the jet pump and which is installed on the logging cable passed through the axial passage of the sealing assembly, the output side of the jet pump is connected to the area around the piping string, the input side of the passage for supplying the pumped out medium to the jet pump is connected to the inner cavity of the piping string below the sealing assembly, and the input side of the passage for supplying the liquid working medium to the active nozzle is connected to the inner cavity of the piping string above the sealing assembly, characterized in that the said well jet unit being provided with the stinger shank intended for slip connection with and disconnection from the drillable packer preliminary arranged in the well and made with the through passage and the check valve closing the throat of that passage and having the possibility of opening to the side of the producing formation, and the packer is made with a central passage and a shank with the guiding cone, being arranged lower than the packer, and is arranged with the possibility of being replaced by the stinger shank, the inner diameters of the stinger shank and the shank with the guiding cone being at least 1 mm greater that the diameter of the transmitter and the receiver-transducer of physical fields, the sealing assembly being arranged with the possibility of being replaced by other functional inserts, including a blocking insert, a pressurizing insert, a depression insert or an insert for recording formation pressure restoration curves with the use of autonomous well instruments; and the transmitter and receiver-transducer of physical fields being made with the possibility of being replaced by other well instruments, including, a puncher or a device for acoustically impacting the producing formation.

* * * * *